US012799940B2

(12) United States Patent
Honda et al.

(10) Patent No.: US 12,799,940 B2
(45) Date of Patent: Nov. 17, 2026

(54) FLUID-PATH SWITCHING APPARATUS AND METHOD OF PREVENTING IDLING ROTATION OF SUBMERSIBLE PUMP

(71) Applicant: EBARA CORPORATION, Tokyo (JP)

(72) Inventors: Shuichiro Honda, Tokyo (JP); Tetsuji Kasatani, Tokyo (JP); Hayato Ikeda, Tokyo (JP); Mitsutaka Iwami, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 77 days.

(21) Appl. No.: 18/253,610

(22) PCT Filed: Aug. 27, 2021

(86) PCT No.: PCT/JP2021/031502
§ 371 (c)(1),
(2) Date: May 19, 2023

(87) PCT Pub. No.: WO2022/113450
PCT Pub. Date: Jun. 2, 2022

(65) Prior Publication Data

US 2024/0011492 A1 Jan. 11, 2024

(30) Foreign Application Priority Data

Nov. 27, 2020 (JP) ..... 2020-196643

(51) Int. Cl.
*F04D 7/02* (2006.01)
*F04D 13/08* (2006.01)
*F04D 29/44* (2006.01)

(52) U.S. Cl.
CPC ..... *F04D 7/02* (2013.01); *F04D 13/086* (2013.01); *F04D 29/445* (2013.01)

(58) Field of Classification Search
CPC ..... F04D 7/02; F04D 13/086; F04D 29/445
See application file for complete search history.

(56) References Cited

U.S. PATENT DOCUMENTS 3,735,777 A * 5/1973 Katzer ..... F16K 17/04 137/516.29
2003/0235506 A1 12/2003 Ichinose
(Continued)

FOREIGN PATENT DOCUMENTS

CN 2525286 Y 12/2002
CN 201358922 Y 12/2009
(Continued)

OTHER PUBLICATIONS

English Translation of JPH06307376A (Year: 1994).*
(Continued)

*Primary Examiner* — Connor J Tremarche
(74) *Attorney, Agent, or Firm* — Chrisman Gallo Tochtrop LLC

(57) ABSTRACT

The present invention relates to a technique of preventing idling rotation of a submersible pump used for delivering liquefied gas, such as liquefied ammonia, liquid hydrogen, liquid nitrogen, liquefied natural gas, liquefied ethylene gas, or liquefied petroleum gas. A fluid-path switching apparatus (5) includes: a flow-passage structure (45) having a first flow passage (41), a second flow passage (42), and a third flow passage (43); and a valve element (47) for allowing the third flow passage (43) to selectively communicate with the first flow passage (41) or the second flow passage (42). The first flow passage (41) communicates with a discharge outlet (1*b*) of the submersible pump (1), the second flow passage (42) communicates with an interior of the suction vessel (2), and the third flow passage (43) communicates with a discharge port (8) of the suction vessel (2).

10 Claims, 12 Drawing Sheets

(56) References Cited

U.S. PATENT DOCUMENTS

| | | | | |
|---|---|---|---|---|
| 2005/0069434 | A1 | 3/2005 | Tani | |
| 2012/0257985 | A1* | 10/2012 | Parmeter | F04D 13/10 417/53 |
| 2012/0257995 | A1* | 10/2012 | True | F04B 35/04 417/410.1 |

FOREIGN PATENT DOCUMENTS

| | | | | | |
|---|---|---|---|---|---|
| CN | 207989809 | U | | 10/2018 | |
| CN | 210484680 | U | | 5/2020 | |
| EP | 1519053 | | | 3/2005 | |
| EP | 3 739 210 | A1 | | 11/2020 | |
| GB | 2434385 | A | * | 7/2007 | E21B 34/08 |
| JP | S58-002497 | A | | 1/1983 | |
| JP | S59-159795 | U | | 10/1984 | |
| JP | S61-162579 | U | | 10/1986 | |
| JP | S62-031680 | Y2 | | 8/1987 | |
| JP | S63259189 | A | * | 10/1988 | |
| JP | H06307376 | A | * | 11/1994 | |
| JP | H07-6510 | B2 | | 1/1995 | |
| JP | H09-217694 | A | | 8/1997 | |
| JP | 2005-214859 | A | | 8/2005 | |
| JP | 2007-024166 | A | | 2/2007 | |
| JP | 4300088 | B2 | | 7/2009 | |
| KR | 20070006404 | | | 1/2007 | |
| KR | 20070006404 | A | * | 11/2007 | |

OTHER PUBLICATIONS

English Translation of JPS63259189A (Year: 1988).*
English Translation of KR-2007-0006404-A (Year: 2007).*
International Search Report issued in Patent Application No. PCT/JP2021/031502 dated Nov. 2, 2021.
European Search Report, issued in EPO Application No. 21897428.5 on Oct. 2, 2024, 7 pages.

* cited by examiner

FLUID-PATH SWITCHING APPARATUS AND METHOD OF PREVENTING IDLING ROTATION OF SUBMERSIBLE PUMP

TECHNICAL FIELD

The present invention relates to a technique of preventing idling rotation of a submersible pump used for delivering liquefied gas, such as liquefied ammonia, liquid hydrogen, liquid nitrogen, liquefied natural gas, liquefied ethylene gas, or liquefied petroleum gas.

BACKGROUND ART

Natural gas is widely used for thermal power generation and as a raw material for chemicals. Furthermore, ammonia and hydrogen are expected to be energies that do not generate carbon dioxide that causes global warming. Applications of hydrogen as an energy include fuel cell and turbine power generation. Natural gas, ammonia, and hydrogen are in a gaseous state at normal temperature, and therefore natural gas, ammonia, and hydrogen are cooled and liquefied for their storage and transportation. Liquefied gas, such as liquefied natural gas (LNG), liquefied ammonia, and liquefied hydrogen, is temporarily stored in a liquefied-gas storage tank and then delivered to a power plant, factory, or the like by a pump.

FIG. 12 is a schematic diagram showing a conventional example of a pump system for pumping up liquefied gas. A pump 500 is installed in a vertical suction vessel 505, which is coupled to a liquefied-gas storage tank (not shown) in which the liquefied gas is stored. The liquefied gas is introduced into the suction vessel 505 through a suction port 501, and the suction vessel 505 is filled with the liquefied gas. The entire pump 500 is immersed in the liquefied gas. Therefore, the pump 500 is a submersible pump that can operate in the liquefied gas. When the pump 500 is operated, the liquefied gas is discharged by the pump 500 through a discharge port 502. During the operation of the pump 500, a part of the liquefied gas in the suction vessel 505 vaporizes into gas, which is exhausted from the suction vessel 505 through a vent line 503.

Before the pump 500 is operated, a drying-up operation of purging air out from the suction vessel 505 with purge gas and a cooling-down operation of cooling the pump 500 with liquefied gas are performed. If the air present in the suction vessel 505 comes into contact with the ultra-low temperature liquefied gas, moisture in the air is cooled and solidified by the liquefied gas, which may impede the rotation of the pump 500. Furthermore, if the pump 500 is at a normal temperature when the pump 500 is started, the ultra-low temperature liquefied gas will vaporize when the liquefied gas contacts the pump 500. In order to prevent such events, the drying-up operation and the cooling-down operation are performed before the pump 500 is operated.

The drying-up operation includes injecting a purge gas (e.g., nitrogen gas) into the suction vessel 505, and the cooling-down operation includes injecting a liquefied gas (e.g., liquefied natural gas) into the suction vessel 505. The purge gas or the liquefied gas injected into the suction vessel 505 fills the suction vessel 505, flows into the pump 500 through an inlet 500*a* of the pump 500, and is discharged through the discharge port 502.

CITATION LIST

Patent Literature

Patent document 1: Japanese laid-open utility model publication No. S59-159795

Patent document 2: Japanese examined utility model publication No. S62-031680

SUMMARY OF INVENTION

Technical Problem

However, the purge gas that has been supplied into the suction vessel 505 for the drying-up operation flows through the pump 500 and may cause idling rotation (or free rotation) of the pump 500. When the pump 500 is forced to idle by the purge gas, sliding parts, such as bearings, may be damaged. Furthermore, the liquefied gas that has been supplied into the suction vessel 505 for the cooling-down operation comes into contact with the normal-temperature pump 500, thus forming a large amount of gas. This gas may cause idling rotation of an impeller of the pump 500, which may cause damage to sliding parts, such as bearings.

Accordingly, the present invention provides a fluid-path switching apparatus capable of preventing idling rotation of a pump due to gas introduced into a suction vessel for the purpose of a drying-up operation or a cooling-down operation for the pump. The present invention also provides a method of preventing idling rotation of a submersible pump.

Solution to Problem

In an embodiment, there is provided a fluid-path switching apparatus for preventing idling rotation of a submersible pump disposed in a suction vessel and used for delivering liquefied gas, comprising: a flow-passage structure having a first flow passage, a second flow passage, and a third flow passage; and a valve element arranged in the flow-passage structure, the valve element being configured to allow the third flow passage to selectively communicate with either the first flow passage or the second flow passage, the first flow passage communicating with a discharge outlet of the submersible pump, the second flow passage communicating with an interior of the suction vessel, and the third flow passage communicating with a discharge port of the suction vessel.

In an embodiment, the flow-passage structure further includes a bypass passage that establishes fluid communication between the first flow passage and the third flow passage, and the bypass passage has a cross-sectional area smaller than a cross-sectional area of the first flow passage.

In an embodiment, the cross-sectional area of the bypass passage is such that an impeller of the submersible pump does not rotate due to flow of gas when the valve element closes the first flow passage and the gas flows through the submersible pump and the bypass passage.

In an embodiment, the fluid-path switching apparatus further comprises a spring configured to press the valve element against the flow-passage structure to close the first flow passage.

In an embodiment, there is provided a pump system comprising: a submersible pump configured to deliver liquefied gas; a suction vessel in which the submersible pump is accommodated; and the fluid-path switching apparatus for preventing idling rotation of the submersible pump.

In an embodiment, the pump system further comprises a rotation detector configured to detect rotation of the submersible pump.

In an embodiment, the pump system further comprises an anti-rotation device configured to prevent rotation of the submersible pump.

In an embodiment, there is provided a method of preventing idling rotation of a submersible pump disposed in a suction vessel and used for delivering liquefied gas, comprising: supplying liquefied gas into the suction vessel when a first flow passage is closed with a valve element, and a second flow passage and a third flow passage are in fluid communication, the first flow passage communicating with a discharge outlet of the submersible pump, the second flow passage communicating with an interior of the suction vessel, the third flow passage communicating with a discharge port of the suction vessel; and delivering gas generated in the suction vessel to the discharge port through the second flow passage and the third flow passage.

In an embodiment, the method further comprises supplying purge gas into the suction vessel before supplying the liquefied gas into the suction vessel.

In an embodiment, the purge gas is supplied into the suction vessel through a suction port of the suction vessel and discharged through a drain line coupled to a bottom of the suction vessel, the suction port being located higher than the bottom of the suction vessel.

In an embodiment, the purge gas is supplied into the suction vessel through a suction port of the suction vessel and discharged through the second flow passage, the third flow passage, and the discharge port.

In an embodiment, the purge gas is supplied into the suction vessel through a drain line coupled to a bottom of the suction vessel and discharged through the second flow passage, the third flow passage, and the discharge port.

In an embodiment, the purge gas is an inert gas composed of element having a boiling point lower than that of an element constituting the liquefied gas.

In an embodiment, the method further comprises operating the submersible pump in a state in which the second flow passage is closed by the valve element and the first flow passage communicates with the third flow passage.

In an embodiment, the method further comprises directing gas generated in the suction vessel through the discharge port to a gas treatment device.

Advantageous Effects of Invention

According to the present invention, gas (e.g., purge gas, or gas generated from liquefied gas, etc.) that has been introduced into the suction vessel during a drying-up operation or a cooling-down operation does not flow into the submersible pump because of the fluid-path switching apparatus, so that the gas is led to the discharge port. Therefore, the impeller of the submersible pump is not forced to idle (or rotate freely), and as a result, damage to sliding parts, such as bearings of the submersible pump, can be prevented.

DESCRIPTION OF EMBODIMENTS

Figure 1:
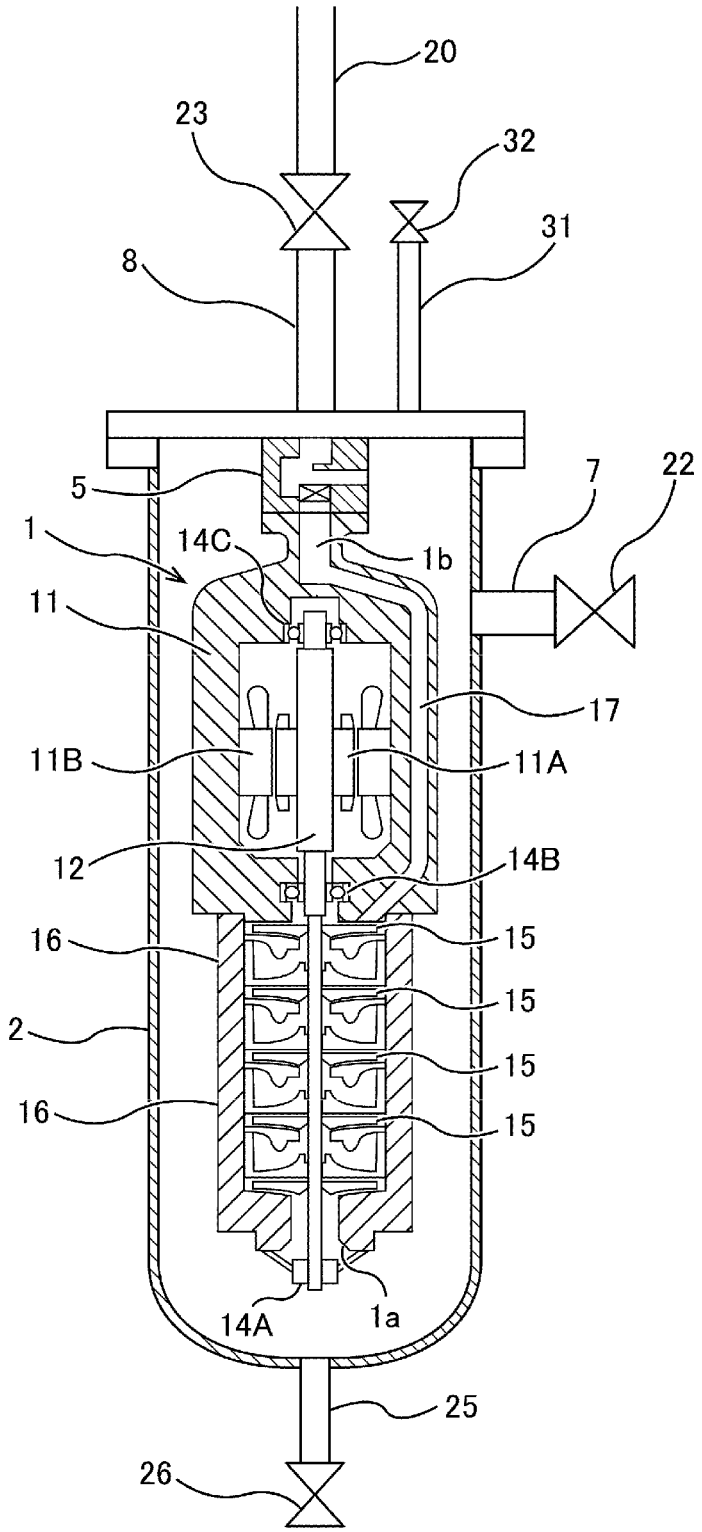
FIG. 1 shows an embodiment of a pump system for delivering liquefied gas.

Hereinafter, embodiments of the present invention will be described with reference to the drawings. FIG. 1 illustrates an embodiment of a pump system for delivering liquefied gas. Examples of the liquefied gas to be delivered by the pump system shown in FIG. 1 include liquefied ammonia, liquid hydrogen, liquid nitrogen, liquefied natural gas, liquefied ethylene gas, liquefied petroleum gas, and the like.

As shown in FIG. 1, the pump system includes a submersible pump 1 for delivering the liquefied gas, a suction vessel 2 in which the submersible pump 1 is accommodated, and a fluid-path switching apparatus 5 for preventing idling rotation of the submersible pump 1. The suction vessel 2 has a suction port 7 and a discharge port 8. The liquefied gas is introduced through the suction port 7 into the suction vessel 2, and an interior of the suction vessel 2 is filled with the liquefied gas. During operation of the submersible pump 1, the entire submersible pump 1 is immersed in the liquefied gas. Therefore, the submersible pump 1 is configured to be operable in the liquefied gas.

The submersible pump 1 includes an electric motor 11 having a motor rotor 11A and a motor stator 11B, a rotation shaft 12 coupled to the electric motor 11, bearings 14A, 14B, and 14C that rotatably support the rotation shaft 12, an impeller 15 secured to the rotation shaft 12, and a pump casing 16 in which the impeller 15 is housed. The fluid-path switching apparatus 5 is arranged in the suction vessel 2. More specifically, the fluid-path switching apparatus 5 is coupled to both a discharge outlet 1*b* of the submersible pump 1 and the discharge port 8 of the suction vessel 2. Specific configurations of the fluid-path switching apparatus 5 will be described later.

When electric power is supplied to the electric motor 11 through a power cable (not shown), the electric motor 11 rotates the rotation shaft 12 and the impeller 15 together. As the impeller 15 rotates, the liquefied gas is sucked into the submersible pump 1 through a suction inlet 1*a* of the submersible pump 1, flows through a discharge flow passage 17 and the discharge outlet 1*b*, and is discharged into the fluid-path switching apparatus 5. Further, the liquefied gas flows through the fluid-path switching apparatus 5 into the discharge port 8 of the suction vessel 2. A discharge pipe 20 is coupled to the discharge port 8, so that the liquefied gas that has flowed through the discharge port 8 is delivered through the discharge pipe 20.

A suction valve 22 is coupled to the suction port 7, and a discharge valve 23 is coupled to the discharge port 8. A drain line 25 is coupled to a bottom of the suction vessel 2, and a drain valve 26 is coupled to the drain line 25. The suction port 7 is provided on a side wall of the suction vessel 2 and is located higher than the bottom of the suction vessel 2. The discharge port 8 is provided on an upper portion of the suction vessel 2 and is located higher than the suction port 7. During operation of the submersible pump 1, the suction valve 22 and the discharge valve 23 are open, and the drain valve 26 is closed. A vent line 31 is coupled to the upper portion of the suction vessel 2. During operation of the submersible pump 1, a part of the liquefied gas evaporates into gas due to heat generation of the submersible pump 1. This gas is discharged from the suction vessel 2 through the vent line 31. A vent valve 32 is coupled to the vent line 31. In one embodiment, this gas may be delivered through the vent line 31 to a gas treatment device (not shown). The gas treatment device is configured to treat the gas (e.g., natural gas, hydrogen gas, or ammonia gas) vaporized from the liquefied gas. Examples of the gas treatment device include gas incinerator (flaring device), chemical gas treatment device, gas adsorption device, and the like.

Figure 2:
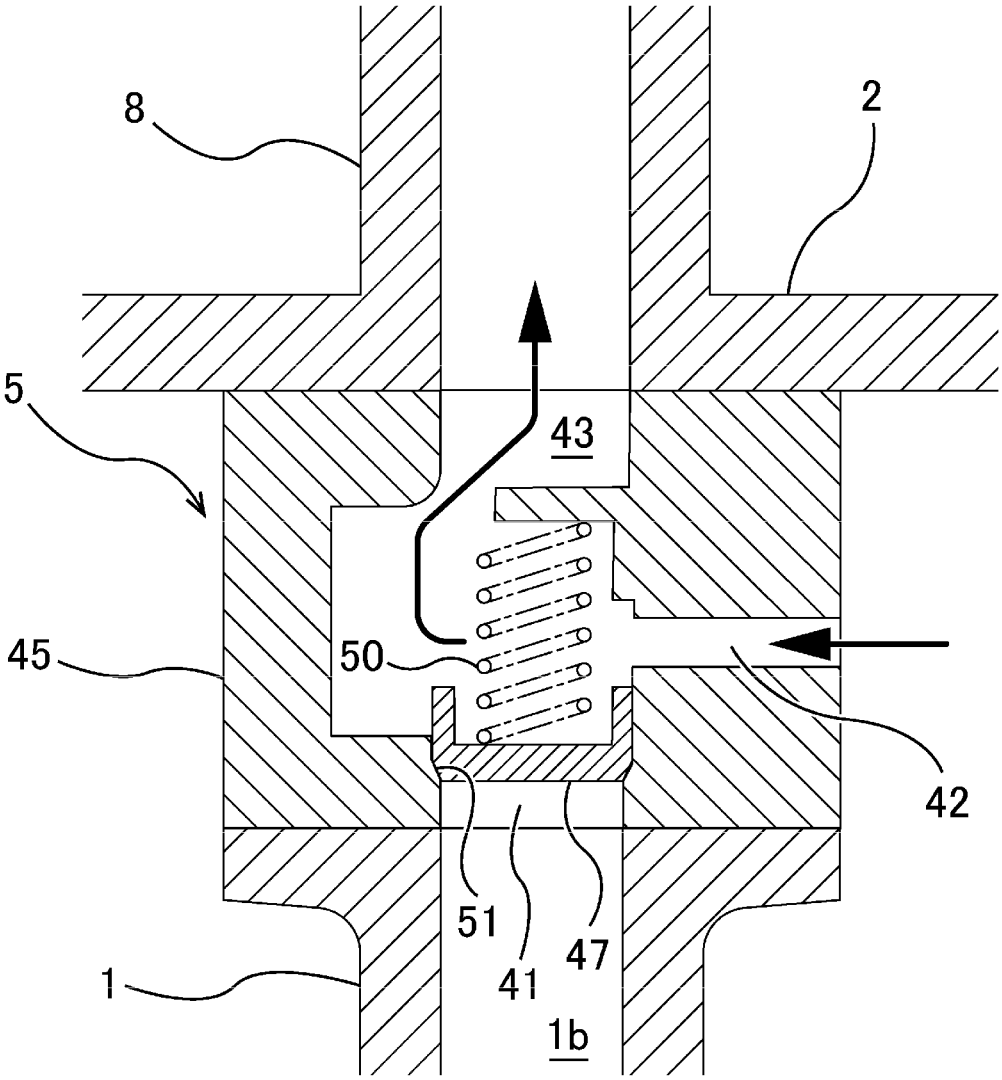
FIG. 2 is a cross-sectional view showing an embodiment of detailed configurations of a fluid-path switching apparatus.

FIG. 2 is a cross-sectional view showing an embodiment of detailed configurations of the fluid-path switching apparatus 5. As shown in FIG. 2, the fluid-path switching apparatus 5 includes a flow-passage structure 45 having a first flow passage 41, a second flow passage 42, and a third flow passage 43, and a valve element 47 arranged in the flow-passage structure 45. The first flow passage 41 communicates with the discharge outlet 1*b* of the submersible pump 1, the second flow passage 42 communicates with the interior of the suction vessel 2, and the third flow passage 43 communicates with the discharge port 8 of the suction vessel 2. The valve element 47 is arranged so as to allow the third flow passage 43 to selectively communicate with either the first flow passage 41 or the second flow passage 42. The configurations of the fluid-path switching apparatus 5 are not limited to the embodiment shown in FIG. 2 as long as its intended function can be achieved.

FIG. 2 shows a state of the fluid-path switching apparatus 5 when the submersible pump 1 is not in operation. The valve element 47 is pressed against the flow-passage structure 45 by a spring 50 to thereby close the first flow passage 41. More specifically, the flow-passage structure 45 has a valve seat 51 formed around an outlet of the first flow passage 41, and the valve element 47 is pressed against the valve seat 51 by the spring 50. Therefore, when the valve element 47 is pressed against the valve seat 51, the first flow passage 41 is closed, while the second flow passage 42 and the third flow passage 43 are in fluid communication. The second flow passage 42 is open in the suction vessel 2 and communicates with the suction port 7 through the interior of the suction vessel 2.

Figure 3:
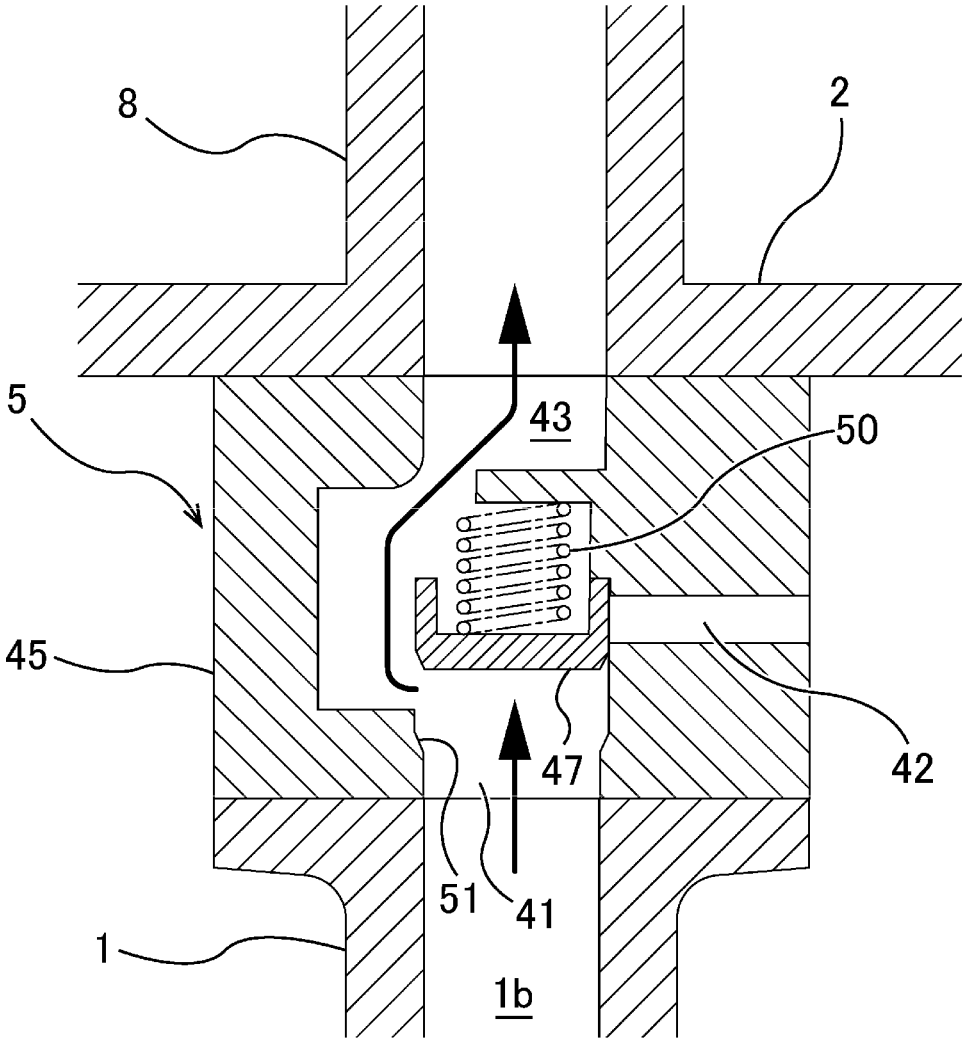
FIG. 3 shows a state of the fluid-path switching apparatus when a submersible pump is in operation.

FIG. 3 shows a state of the fluid-path switching apparatus 5 when the submersible pump 1 is in operation. When the submersible pump 1 is in operation, the liquefied gas is discharged from the discharge outlet 1*b* of the submersible pump 1 and flows into the first flow passage 41 of the fluid-path switching apparatus 5. The liquefied gas flowing through the first flow passage 41 moves the valve element 47 against the force of the spring 50 to open the first flow passage 41 and close the second flow passage 42 with the valve element 47. As a result, the first flow passage 41 and the third flow passage 43 communicate with each other.

When the operation of the submersible pump 1 is stopped, the valve element 47 is pressed against the valve seat 51 by the spring 50. As a result, as shown in FIG. 2, the first flow passage 41 is closed, and the second flow passage 42 and the third flow passage 43 communicate with each other. In this manner, the fluid-path switching apparatus 5 of this embodiment operates only by the spring 50 and the flow of the liquefied gas. In one embodiment, the fluid-path switching apparatus 5 may have an actuator (for example, an electrical actuator or a hydraulic actuator) configured to move the valve element 47.

Before the operation of the submersible pump 1 is started, a drying-up operation is performed which is to remove air from the suction vessel 2 with purge gas, and a cooling-down operation is performed which is to cool the submersible pump 1 with the liquefied gas. The drying-up operation and the cooling-down operation are performed in the state shown in FIG. 2, i.e., in the state in which the first flow passage 41 is closed with the valve element 47, and the second flow passage 42 and the third flow passage 43 are in fluid communication.

The drying-up operation is an operation of introducing purge gas having a normal temperature into the suction vessel 2 to dry the submersible pump 1. An embodiment of the drying-up operation will be described below with reference to FIG. 4. The purge gas is delivered through the suction port 7 into the suction vessel 2 while the submersible pump 1 is not in operation (i.e., the state shown in FIG. 2). The discharge valve 23 and the vent valve 32 are closed, and the suction valve 22 and the drain valve 26 are open. The vent valve 32 may be open. The purge gas purges the air present in the suction vessel 2 and is discharged together with the air through the drain line 25. The interior of the suction vessel 2 is filled with the purge gas, which dries the submersible pump 1.

Figure 5:
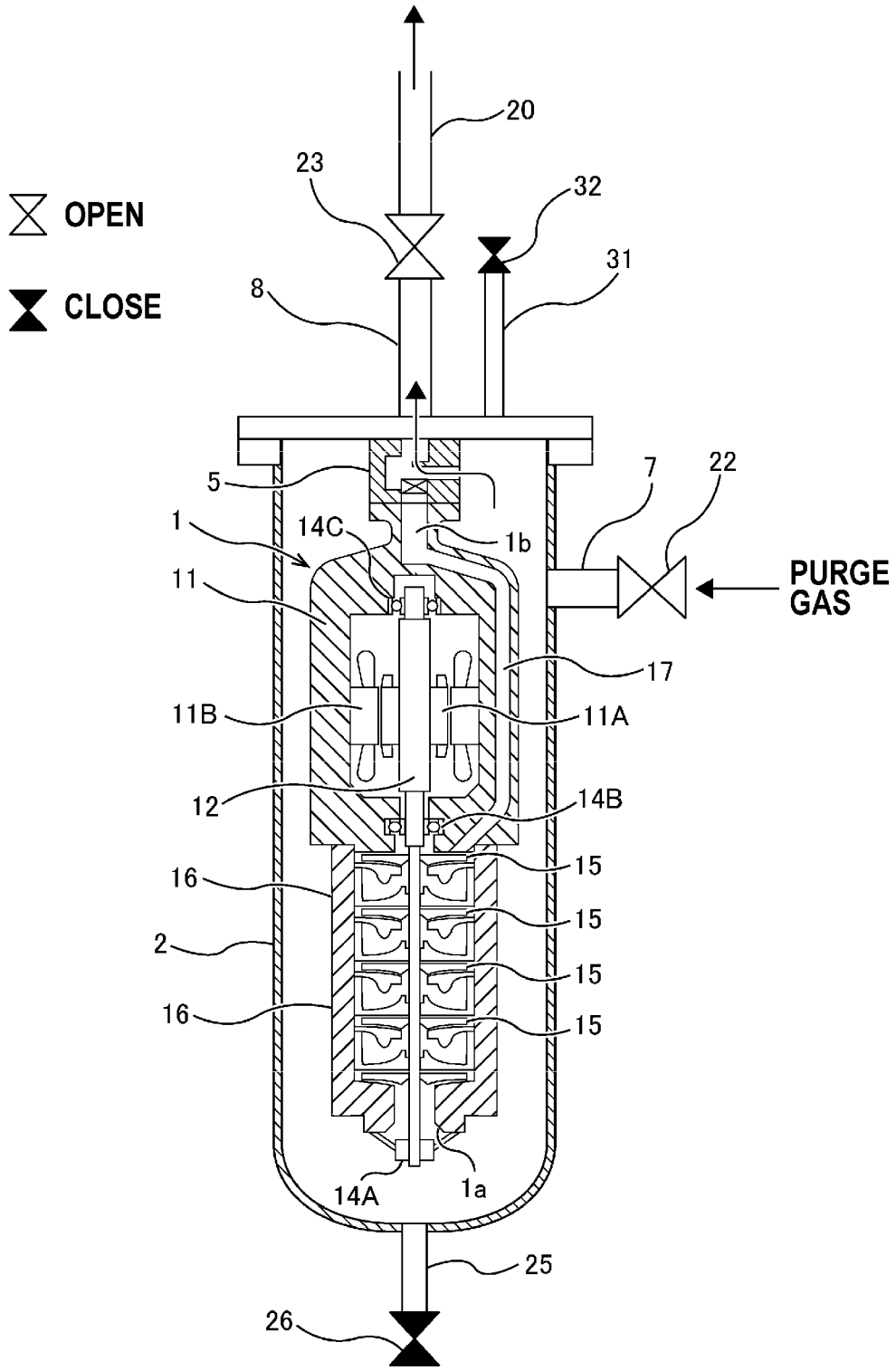
FIG. 5 is a diagram for explaining another embodiment of the drying-up operation.

In one embodiment, the drying-up operation may be performed as follows. As shown in FIG. 5, when the submersible pump 1 is not in operation (i.e., the state shown in FIG. 2), the purge gas is delivered through the suction port 7 into the suction vessel 2. The drain valve 26 and the vent valve 32 are closed, and the suction valve 22 and the discharge valve 23 are open. The vent valve 32 may be open. The purge gas purges the air present in the suction vessel 2 and is discharged together with the air through the second flow passage 42 and the third flow passage 43 of the fluid-path switching apparatus 5 and the discharge port 8. The interior of the suction vessel 2 is filled with the purge gas, which dries the submersible pump 1.

Figure 6:
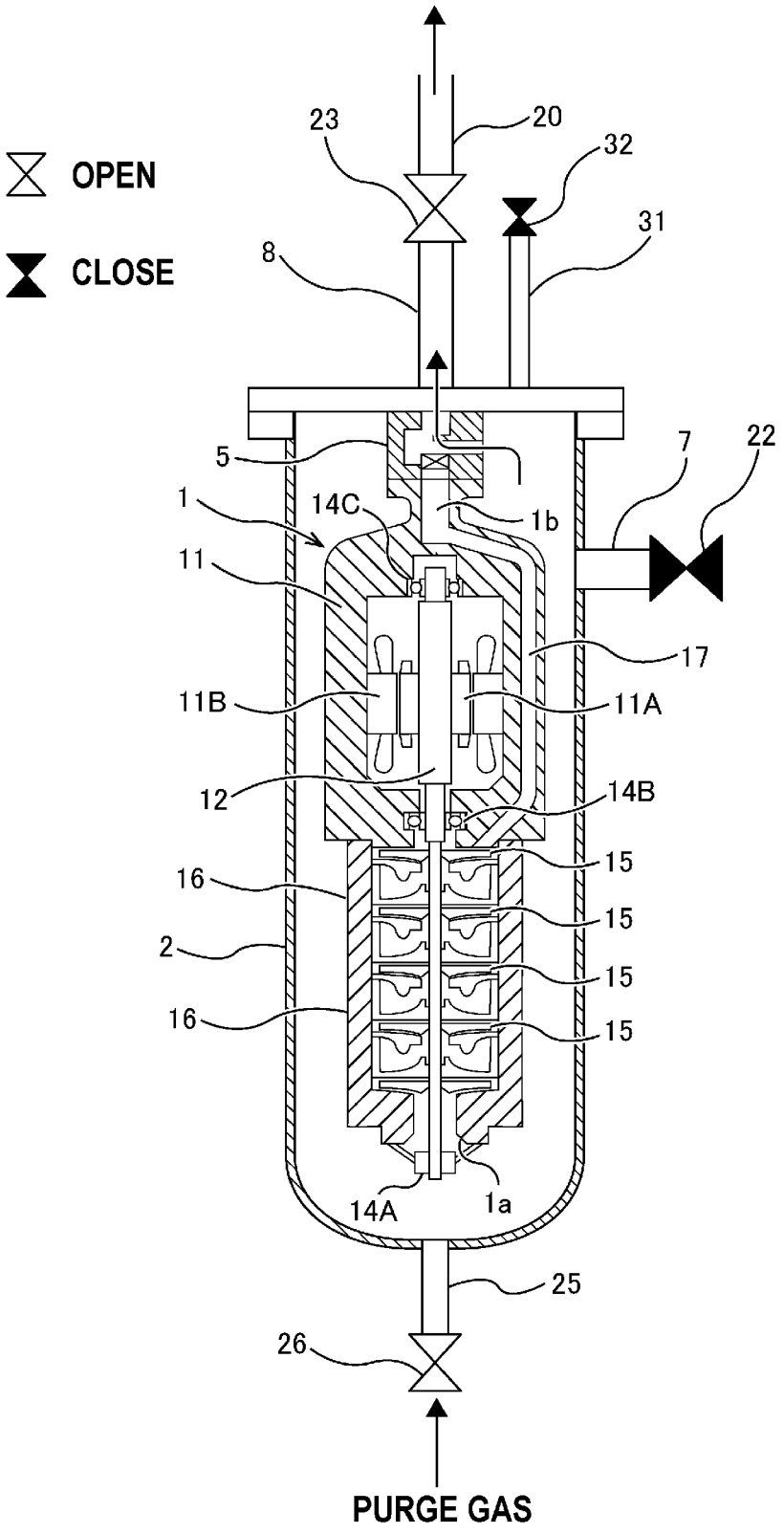
FIG. 6 is a diagram for explaining still another embodiment of the drying-up operation.

Furthermore, in one embodiment, the drying-up operation may be performed as follows. As shown in FIG. 6, when the submersible pump 1 is not in operation (i.e., the state shown in FIG. 2), the purge gas is delivered through the drain line 25 into the suction vessel 2. The suction valve 22 and the vent valve 32 are closed, and the drain valve 26 and the discharge valve 23 are open. The vent valve 32 may be open. The purge gas purges the air present in the suction vessel 2 and is discharged together with the air through the second flow passage 42 and the third flow passage 43 of the fluid-path switching apparatus 5 and the discharge port 8. The interior of the suction vessel 2 is filled with the purge gas, which dries the submersible pump 1.

Figure 4:
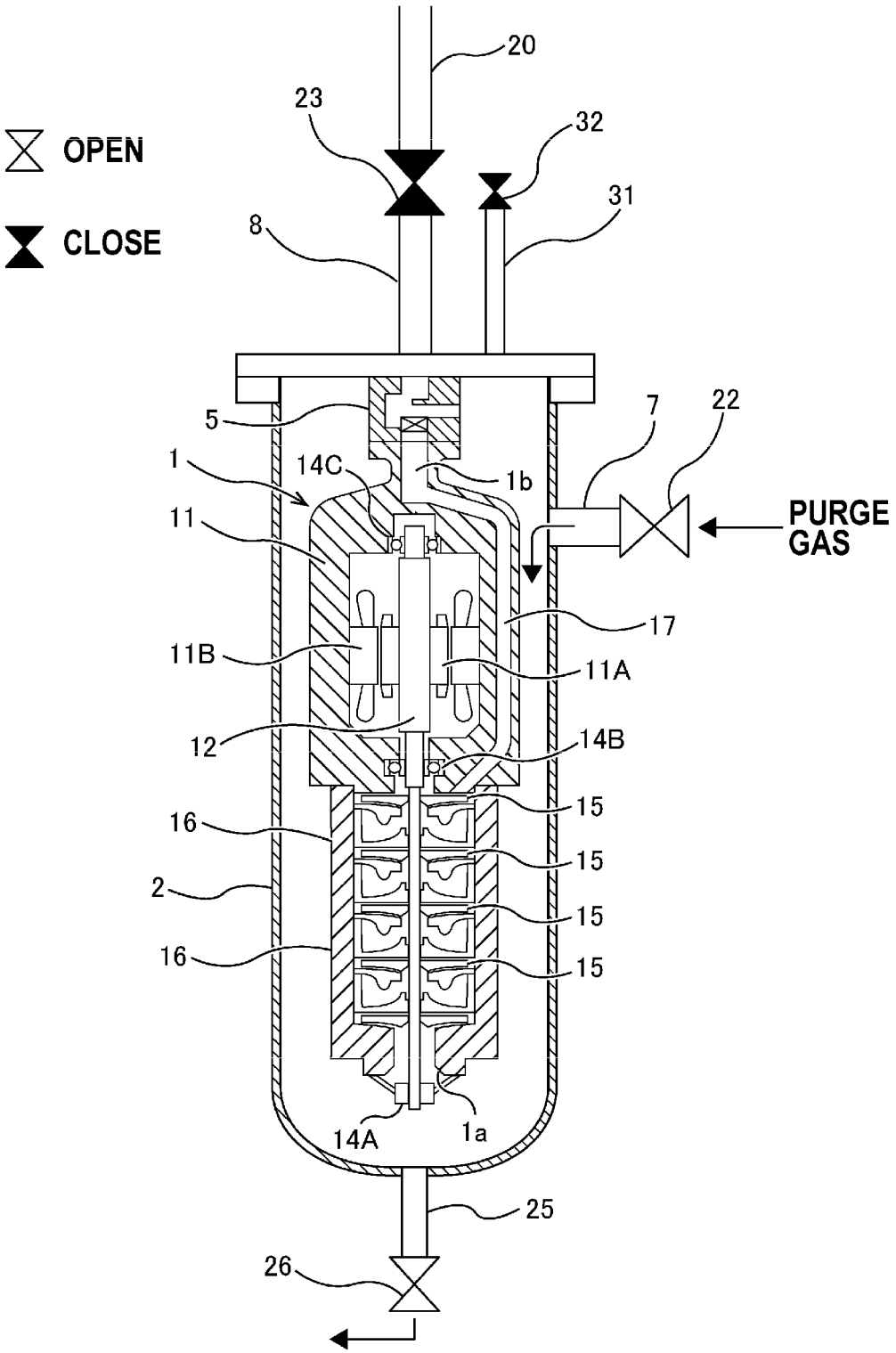
FIG. 4 is a diagram for explaining an embodiment of a drying-up operation.

In the embodiments shown in FIGS. 4 to 6, the first flow passage 41 is closed by the valve element 47. Therefore, the purge gas introduced into the suction vessel 2 does not flow through the submersible pump 1. As a result, idling rotation of the impeller 15 of the submersible pump 1 is prevented, and sliding parts, such as the bearings 14A, 14B, 14C, are prevented from being damaged.

The purge gas used for the drying-up operation is an inert gas composed of element having a boiling point lower than that of an element constituting the liquefied gas. This is to prevent the purge gas from being liquefied when the purge gas comes into contact with the cryogenic liquefied gas introduced after the drying-up operation. For example, if the liquefied gas is liquefied natural gas (LNG) or liquefied ammonia, the purge gas used is nitrogen gas. In another example, if the liquefied gas is liquid hydrogen, the purge gas used is helium gas.

Figure 7:
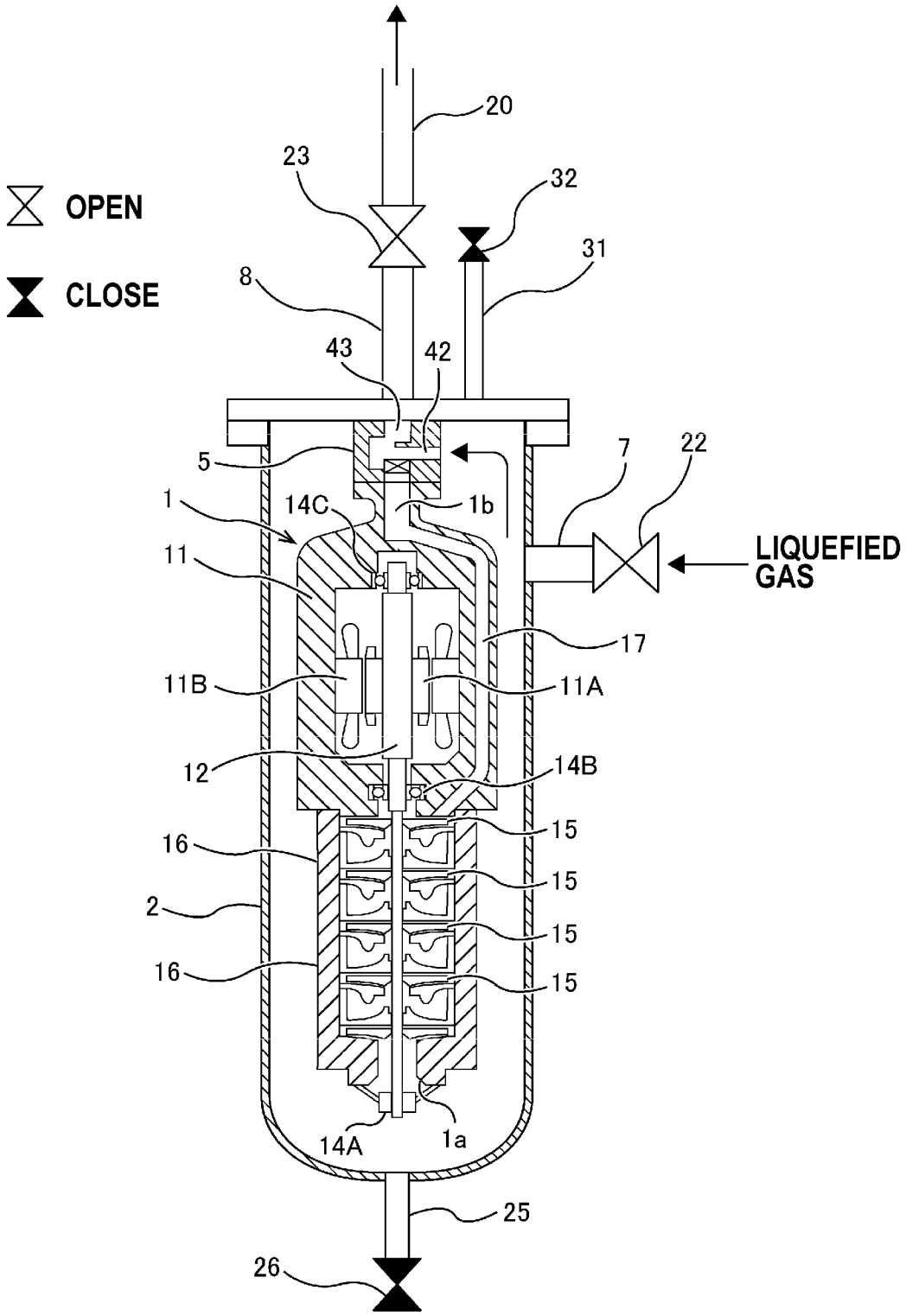
FIG. 7 is a diagram for explaining an embodiment of a cooling-down operation.

The cooling-down operation is an operation of introducing the liquefied gas into the suction vessel 2 to cool the submersible pump 1 after the drying-up operation. An embodiment of the cooling-down operation will be described below with reference to FIG. 7. As shown in FIG. 7, when the submersible pump 1 is not in operation (i.e., the state shown in FIG. 2), the liquefied gas is delivered through the suction port 7 into the suction vessel 2. The drain valve 26 and the vent valve 32 are closed, and the suction valve 22 and the discharge valve 23 are open. The vent valve 32 may be open. The liquefied gas comes into contact with the submersible pump 1 and the suction vessel 2 each having a normal temperature and vaporizes to generate gas (hereinafter referred to as generated gas). The generated gas is discharged through the second flow passage 42 and the third flow passage 43 of the fluid-path switching apparatus 5 and the discharge port 8. As the temperatures of the submersible pump 1 and the suction vessel 2 decrease, the liquefied gas will no longer vaporize. The interior of the suction vessel 2 is filled with the liquefied gas, which cools the submersible pump 1.

The first flow passage 41 is closed by the valve element 47 in the embodiment of FIG. 7. Therefore, the generated gas in the suction vessel 2 does not flow through the submersible pump 1. As a result, the idling rotation of the impeller 15 of the submersible pump 1 is prevented, and the sliding parts, such as the bearings 14A, 14B, 14C, are prevented from being damaged.

As shown in FIG. 7, the generated gas is discharged through the discharge port 8 and the discharge pipe 20. The discharge port 8 and the discharge pipe 20 typically have a larger diameter than those of the vent line 31 and the drain line 25. Therefore, the liquefied gas for cooling the submersible pump 1 can be introduced into the suction vessel 2 at a high flow rate. As a result, the cooling-down operation can be completed in a short time. In particular, according to the present embodiment, even if the liquefied gas is introduced into the suction vessel 2 at a high flow rate, the fluid-path switching apparatus 5 prevents the generated gas (gas generated as a result of vaporization of the liquefied gas) from flowing through the submersible pump 1 and can therefore prevent the idling rotation of the submersible pump 1.

In one embodiment, the generated gas in the suction vessel 2 may be directed through the discharge port 8 and the discharge pipe 20 to a gas treatment device (not shown). The gas treatment device is configured to treat the gas (e.g., natural gas, hydrogen gas, or ammonia gas) vaporized from the liquefied gas. Examples of the gas treatment device include gas incinerator (flaring device), chemical gas treatment device, gas adsorption device, and the like.

Figure 8:
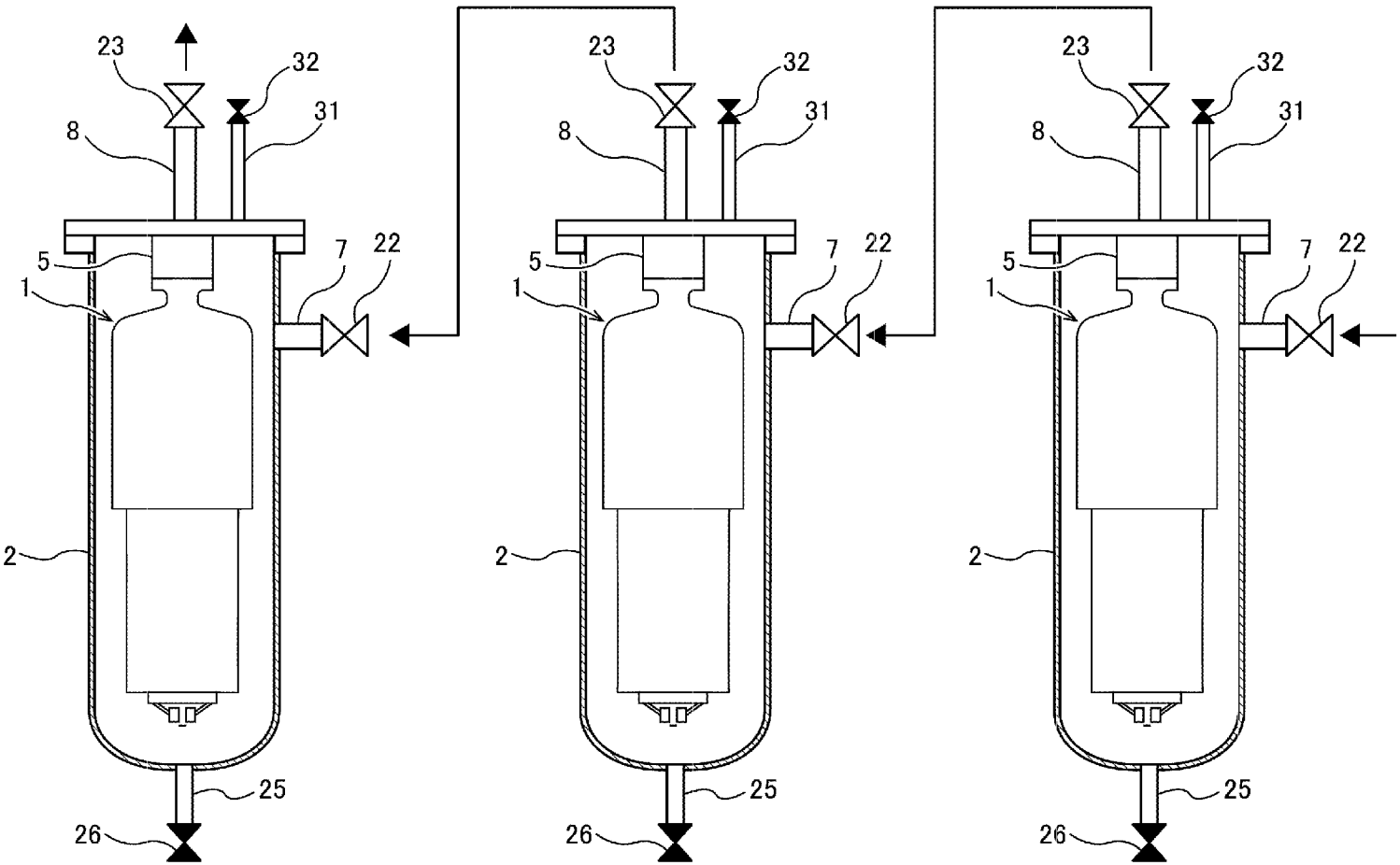
FIG. 8 is a diagram for explaining an embodiment of simultaneously cooling a plurality of submersible pumps.

As shown in FIG. 8, it is possible to couple a plurality of suction vessels 2 in series to cool a plurality of submersible pumps 1 simultaneously. Specifically, a discharge port 8 of one suction vessel 2 accommodating one submersible pump 1 is coupled to a suction port 7 of another suction vessel 2 accommodating another submersible pump 1. Three or more suction vessels 2 can be coupled in series in the same way. The liquefied gas is introduced into a suction port 7 of one of the plurality of suction vessels 2, flows through each suction vessel 2 and is discharged from a discharge port 8 of another of the plurality of suction vessels 2. The liquefied gas flowing through these suction vessels 2 can cool the multiple submersible pumps 1 simultaneously.

Figure 9:
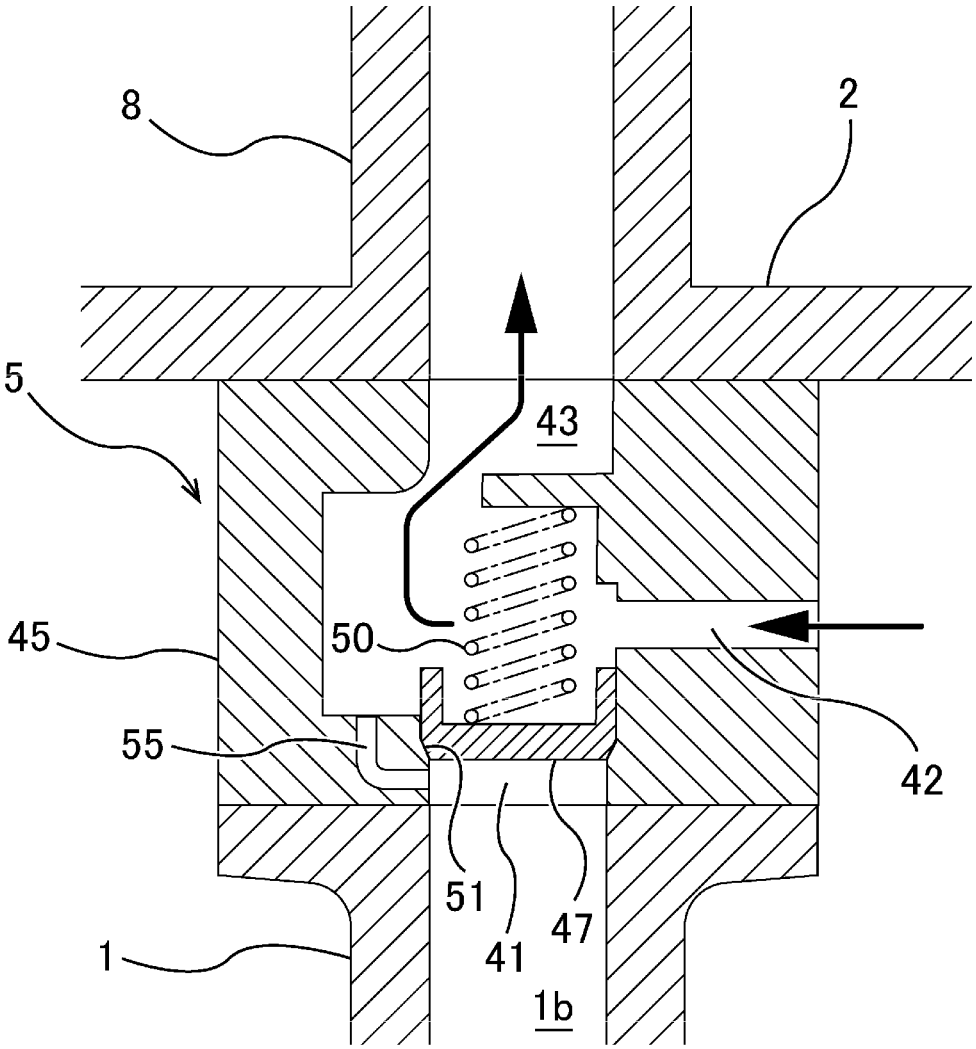
FIG. 9 is a cross-sectional view showing another embodiment of the fluid-path switching apparatus.

FIG. 9 is a cross-sectional view showing another embodiment of the fluid-path switching apparatus 5. Configurations and operations of this embodiment, which will not be specifically described, are the same as those of the embodiments described with reference to FIGS. 2 and 3, and their repetitive descriptions will be omitted. As shown in FIG. 9, the flow-passage structure 45 has a bypass passage 55 that establishes fluid communication between the first flow passage 41 and the third flow passage 43. The bypass passage 55 has a cross-sectional area smaller than a cross-sectional area of the first flow passage 41. More specifically, the cross-sectional area of the bypass passage 55 is such that the rotation of the impeller 15 of the submersible pump 1 due to the gas flow does not occur when the valve element 47 closes the first flow passage 41 and the gas (the purge gas or the generated gas) flows through the submersible pump 1 and the bypass passage 55.

The bypass passage 55 may be a through-hole as shown in FIG. 9 or may be a groove formed in the valve seat 51. A plurality of bypass passages 55 may be provided as long as the above-described gas does not cause the rotation of the impeller 15. According to this embodiment, the purge gas or the liquefied gas can be smoothly introduced into the submersible pump 1 during the drying-up operation and the cooling-down operation. As a result, the drying-up operation and the cooling-down operation for the submersible pump 1 can be completed in a shorter time.

Figure 10:
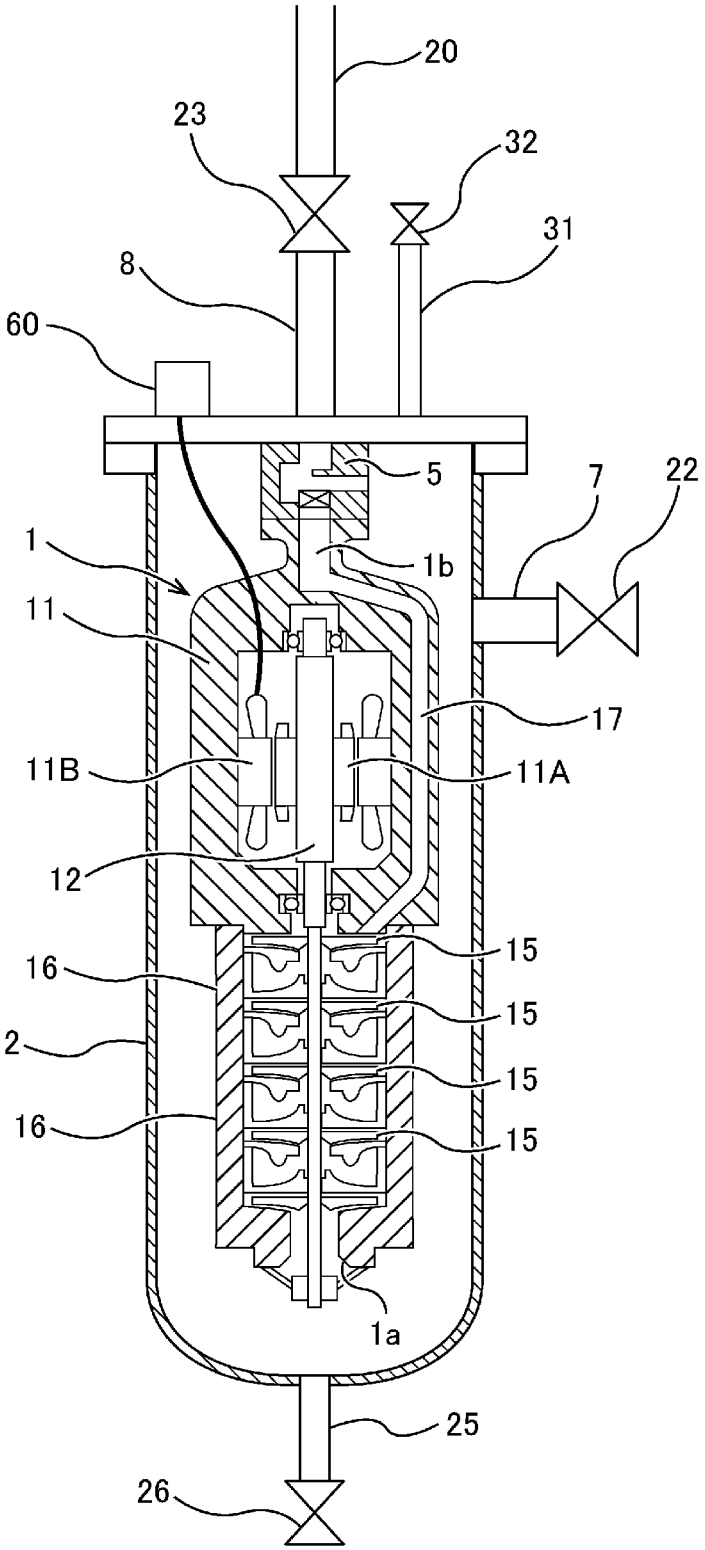
FIG. 10 shows an embodiment of a pump system including a rotation detector.

As shown in FIG. 10, in one embodiment the pump system may include a rotation detector 60 configured to detect the rotation of the submersible pump 1. A specific configuration of the rotation detector 60 is not particularly limited as long as the rotation detector 60 can detect the rotation of the submersible pump 1 (i.e., the rotation of the rotation shaft 12 or the impeller 15). In the example shown in FIG. 10, the rotation detector 60 is an induced electromotive force detector configured to detect an induced electromotive force generated when the electric motor 11 is rotating. In another example, although not shown, the rotation detector 60 may be configured to directly detect the rotation of the rotation shaft 12 or the impeller 15. Based on an output value of the rotation detector 60, the cross-sectional area of the bypass passage 55 that does not cause the rotation of the submersible pump 1 can be determined.

Figure 11:
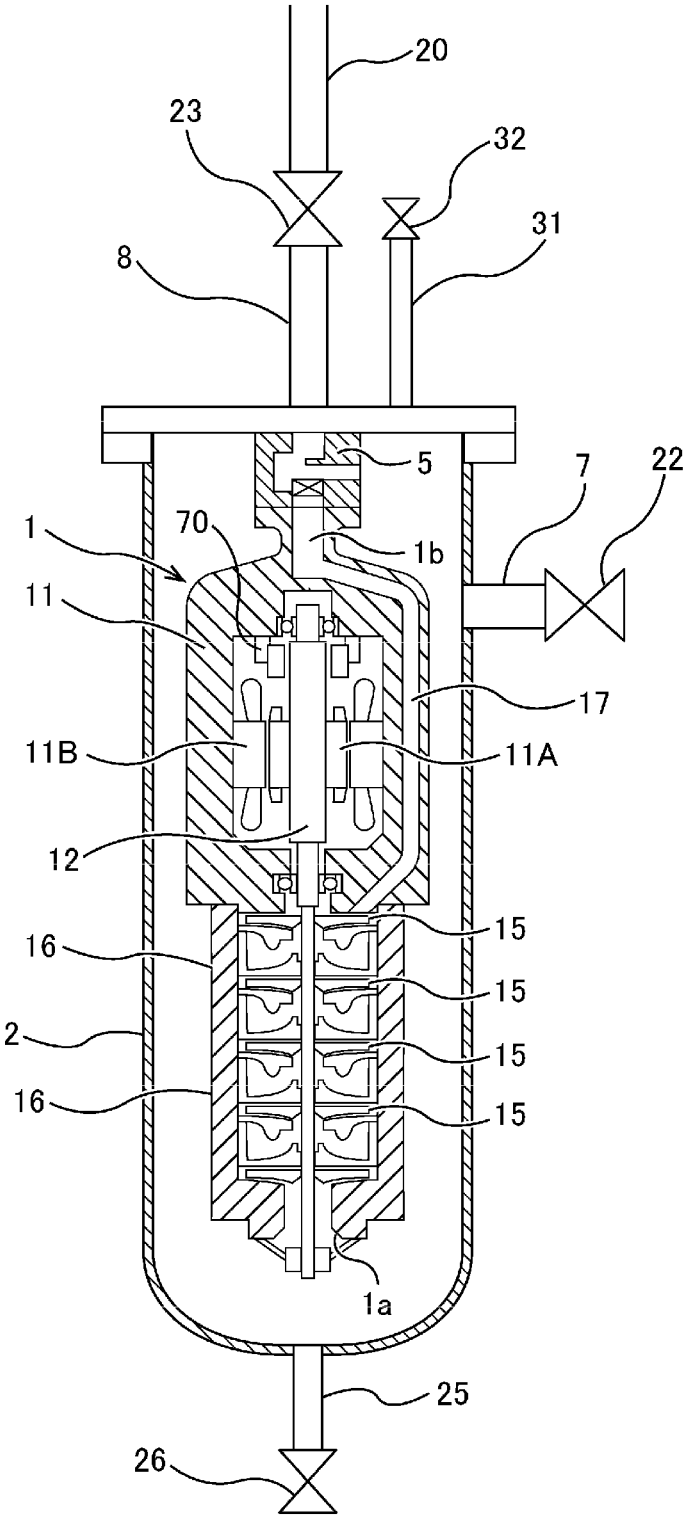
FIG. 11 shows an embodiment of a pump system including an anti-rotation device.
Figure 12:
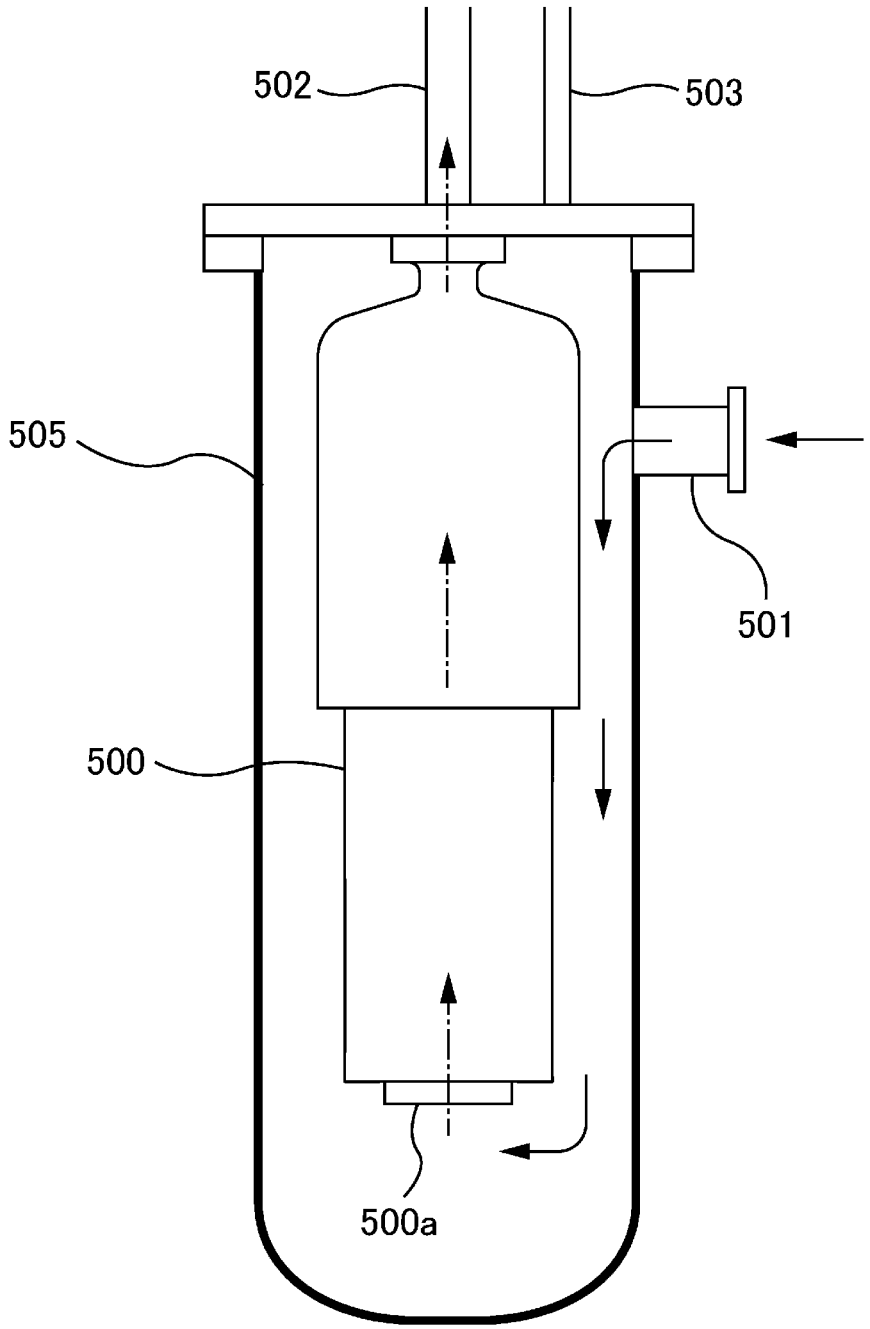
FIG. 12 is a schematic diagram showing a conventional example of a pump system for pumping up liquefied gas.

As shown in FIG. 11, in one embodiment, the pump system may further include an anti-rotation device 70 configured to prevent the rotation of the submersible pump 1. A specific configuration of the anti-rotation device 70 is not particularly limited as long as the anti-rotation device 70 can prevent the rotation of the submersible pump 1 (i.e., rotation of the rotation shaft 12 or the impeller 15). For example, the anti-rotation device 70 may be a mechanical anti-rotation device configured to press a brake pad against the rotation shaft 12 to prevent the rotation of the rotation shaft 12 and the impeller 15. Examples of actuator that moves the brake pad include a hydraulic actuator (e.g., a gas cylinder), an electrical actuator (e.g., an electromagnetic solenoid), and the like. In another example, the anti-rotation device 70 may be an electromagnetic anti-rotation device configured to energize a coil to generate an electromagnetic force that prevents the rotation of the rotation shaft 12 and the impeller 15.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a technique of preventing idling rotation of a submersible pump used for delivering liquefied gas, such as liquefied ammonia, liquid hydrogen, liquid nitrogen, liquefied natural gas, liquefied ethylene gas, or liquefied petroleum gas.

REFERENCE SIGNS LIST

1 submersible pump
1*a* suction inlet
1*b* discharge outlet
2 suction vessel
5 fluid-path switching apparatus
7 suction port
8 discharge port
11 electric motor
12 rotation shaft
14A,14B,14C bearing
15 impeller
16 pump casing
17 discharge flow passage
20 discharge pipe
22 suction valve
23 discharge valve
25 drain line
26 drain valve
31 vent line
32 vent valve
41 first flow passage
42 second flow passage
43 third flow passage
45 flow-passage structure
47 valve element
50 spring
51 valve seat
55 bypass passage
60 rotation detector
70 anti-rotation device

What is claimed is:

1. A fluid-path switching apparatus for preventing idling rotation of a submersible pump disposed in a suction vessel and used for delivering liquefied gas, comprising:

a flow-passage structure having a first flow passage, a second flow passage, and a third flow passage;

a valve element arranged in the flow-passage structure, the valve element being configured to close either the first flow passage or the second flow passage to allow the third flow passage to selectively communicate with either the first flow passage or the second flow passage, the first flow passage being coupled to a discharge outlet of the submersible pump, the second flow passage having an opening located in an interior of the suction vessel, a suction inlet of the submersible pump being located in the interior of the suction vessel, and the third flow passage being coupled to a discharge port of the suction vessel; and a spring configured to press the valve element against a valve seat formed around an outlet of the first flow passage to close the first flow passage.

2. The fluid-path switching apparatus according to claim 1, wherein the flow-passage structure further includes a bypass passage that bypasses the valve element to establish fluid communication between the first flow passage and the third flow passage when the valve element closes the first flow passage, and the bypass passage has a cross-sectional area smaller than a cross-sectional area of the first flow passage.

3. The fluid-path switching apparatus according to claim 2, wherein the cross-sectional area of the bypass passage is such that an impeller of the submersible pump does not rotate due to flow of gas when the valve element closes the first flow passage and the gas flows through the submersible pump and the bypass passage.

4. The fluid-path switching apparatus according to claim 1, wherein the valve seat has a tapered recess shape.

5. The fluid-path switching apparatus according to claim 1, wherein the valve element has a side surface configured to close the second flow passage, and the side surface of the valve element is parallel with a moving direction of the valve element.

6. A pump system comprising:

a submersible pump configured to deliver liquefied gas, the submersible pump having a suction inlet for the liquefied gas;

a suction vessel in which the submersible pump is accommodated, the suction vessel having a suction port for introducing the liquefied gas therein, the suction inlet of the submersible pump being located in an interior of the suction vessel; and a fluid-path switching apparatus for preventing idling rotation of the submersible pump, the fluid-path switching apparatus including:

a flow-passage structure having a first flow passage, a second flow passage, and a third flow passage;

a valve element arranged in the flow-passage structure, the valve element being configured to close either the first flow passage or the second flow passage to allow the third flow passage to selectively communicate with either the first flow passage or the second flow passage, the first flow passage being coupled to a discharge outlet of the submersible pump, the second flow passage having an opening located in the interior of the suction vessel, the interior of the suction vessel being in fluid communication with the suction inlet of the submersible pump, and the third flow passage being coupled to a discharge port of the suction vessel; and a spring configured to press the valve element against a valve seat formed around an outlet of the first flow passage to close the first flow passage.

7. The pump system according to claim 6, further comprising a rotation detector configured to detect rotation of the submersible pump.

8. The pump system according to claim 6, further comprising an anti-rotation device configured to prevent rotation of the submersible pump.

9. The pump system according to claim 6, wherein the valve seat has a tapered recess shape.

10. The pump system according to claim 6, wherein the valve element has a side surface configured to close the second flow passage, and the side surface of the valve element is parallel with a moving direction of the valve element.

* * * * *